United States Patent [19]

Goodell

[11] Patent Number: 4,593,605

[45] Date of Patent: Jun. 10, 1986

[54] FLUID POWER TRANSFER DEVICE

[75] Inventor: Bradley D. Goodell, Anoka, Minn.

[73] Assignee: FMC Corporation, Chicago, Ill.

[21] Appl. No.: 742,241

[22] Filed: Jun. 7, 1985

[51] Int. Cl.[4] ..... F15B 13/00

[52] U.S. Cl. ..... 91/528; 91/44; 91/168; 901/22; 901/50; 92/110

[58] Field of Search ..... 91/528, 531, 44, 167 R, 91/168; 92/110; 901/22, 2, 16–18, 50, 43, 40; 414/749, 751, 753, 728, 744 A

[56] References Cited

U.S. PATENT DOCUMENTS

| | | | |
|---|---|---|---|
| 2,139,185 | 12/1938 | Engel | 91/44 X |
| 2,867,185 | 1/1959 | Hayward | 901/22 X |
| 3,672,257 | 6/1972 | Yunoki et al. | 91/168 |
| 3,912,317 | 10/1975 | Ohnaka | 901/22 X |
| 4,294,572 | 10/1981 | Pattison | 92/110 X |

*Primary Examiner*—Larry Jones
*Assistant Examiner*—Allen J. Flanigan
*Attorney, Agent, or Firm*—Ronald C. Kamp; Richard B. Megley

[57] ABSTRACT

A hoseless arrangement for supplying pressure and tank passages in remote hydraulic device including an extend tube, with pressure and tank passages, and an extend cylinder each reciprocably mounted on a base with a pair of concentric tubes attached to the extend cylinder and to the extend tube, the inner tube communicating with one side of the extend cylinder and the outer tube with the other side thereof. A shuttle valve on the extend tube is connected to shift so that the pressure passage is always subjected to high pressure and the tank passage is always subjected to low pressure.

5 Claims, 1 Drawing Figure

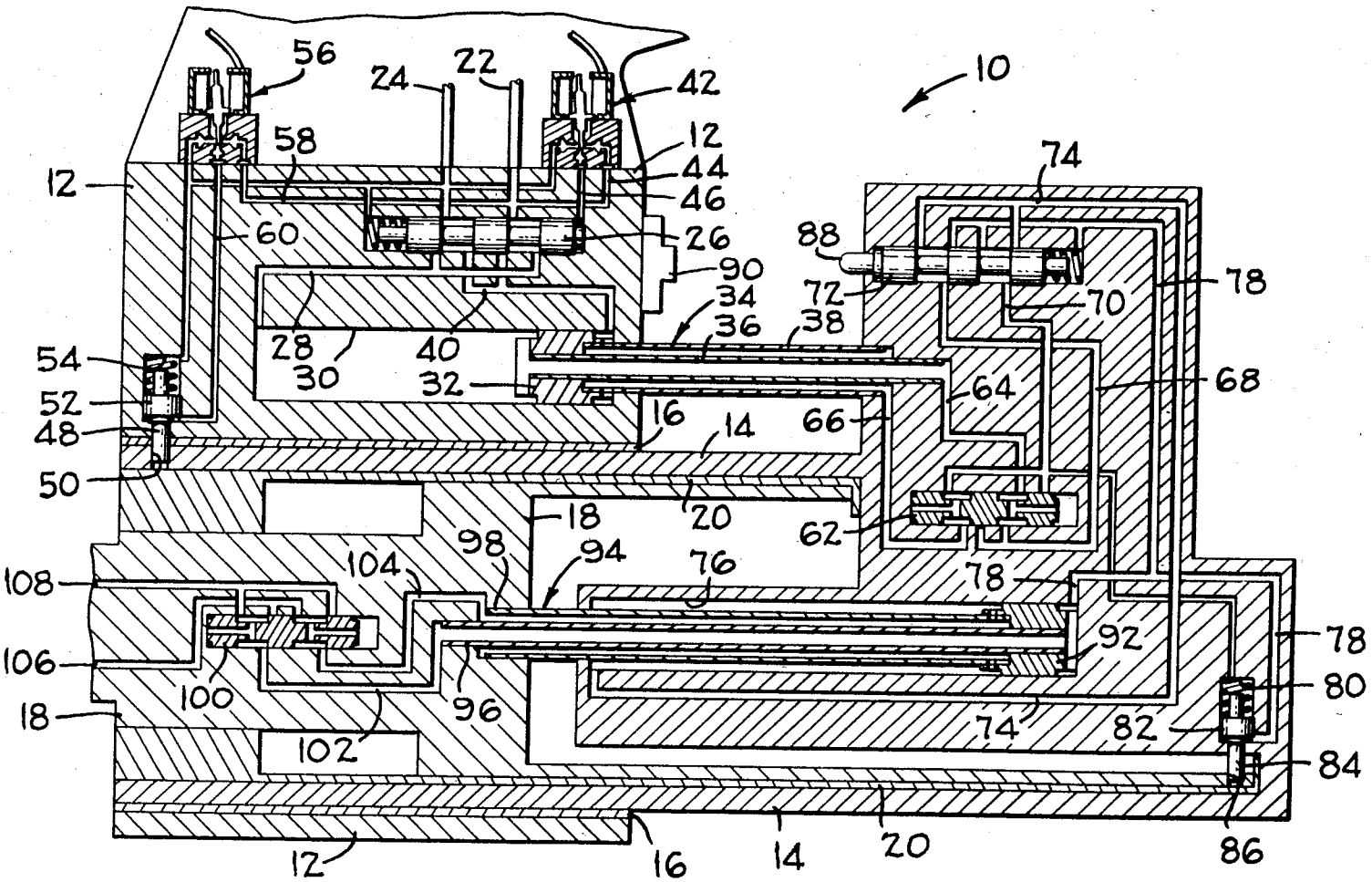
10
12
14
16
18
20
22
24
26
28
30
32
34
36
38
40
42
44
46
48
50
52
54
56
58
60
62
64
66
68
70
72
74
76
78
80
82
84
86
88
90
92
94
96
98
100
102
104
106
108

FLUID POWER TRANSFER DEVICE

This invention relates to fluid power transfer devices, and more particularly to such devices which can supply fluid power to an extendable arm without the use of flexible fluid hoses.

Hydraulically activated devices which must be independently controlled and which are suspended from an extendable arm, such as a robotic arm, have required flexible hoses extended between the base supporting the arm and the device. Such hoses are cumbersome, often vulnerable to being damaged, require means to control their flexing during extension and retraction of the arm, and occupy an inordinate amount of space.

The present invention provides an extendable arm which is capable of supplying fluid power for activation of a remote device without requiring any flexible hoses, which is compact, which is reliable and which is relatively easy to manufacture and maintain. These and other attributes of the present invention and many of its attendant advantages will become more readily apparent from a perusal of the following description and the accompanying drawing, which is a schematic representation of a robotic arm incorporating the invention.

Referring to the drawing, there is shown a robotic arm indicated generally at 10, having a fixed base 12 on which an extend tube 14 is reciprocably mounted by means of bearing 16. An arm 18 is reciprocably retained within the extend tube 14 by bearing 20. Hydraulic fluid pressure is supplied to the base 12 through a conduit 22 and a return conduit 24 is connected with the tank or reservoir of a conventional hydraulic system supplying the fluid pressure. A control shuttle valve 26 is spring biased toward the right to the position shown in the drawing. In this position, pressure conduit 22 communicates with a passage 28 leading to the head end of a cylinder 30 in which a piston 32 is reciprocably retained. A rod 34 is affixed at one end to the piston 32 and is effectively attached at its other end to the extend tube 14. The rod 34 has two independent internal passages which may take the form of concentric inner and outer tubes 36 and 38 respectively. The inner tube 36 communicates with the head end of the cylinder 30 and the outer tube 38 with the rod end side. Pressure directed to the head end of the cylinder 30 will cause the piston 32 to be moved toward the right and the rod 34 to extend, as shown in the drawing. The fluid displaced by this movement of the piston 32 will be returned to tank through a passage 40 connected to the rod end of the cylinder 30 and communicating with conduit 24 when the control shuttle valve 26 is positioned as shown.

An electrically actuated servo control valve 42 is mounted on the base 12 and, when shifted from the position shown in the drawing, directs pressure through branch passage 44 to a passage 46 connected to the right end of the control shuttle valve 26 which pressure overcomes the spring bias and shifts this valve to the left. When shifted to the left, the pressure conduit 22 is in communication with the passage 40 and tank conduit 24 with passage 28. The pressure acting on the rod end of the piston 32 will urge the rod 34 to be retracted and the extend tube 14 attached thereto to be moved to the left. Such action, however, cannot occur until a latch pin 48 carried by the base 12 is extracted from a complementary hole 50 in the extend tube 14. A latch piston 52 is attached to the pin 48 and is reciprocably retained in a latch cylinder 54. The pin 48 is spring bias to an outward or latch position wherein it will engage hole 50 when registry occurs. An electrically activated solenoid valve 56 mounted on the base 12, when shifted from the position shown in the drawing, directs pressure in branch pressure conduit 58 to a conduit 60 connected to the cylinder 54. The pressure force on the pin side of the piston 52 will exceed the spring bias and move the pin 48 upward extracting it from the hole 50.

A shuttle valve 62 is carried by the extend tube 14 and is connected to the inner and outer tubes by means of passages 64 and 66 respectively. A pressure outlet passage 68 is also connected to the valve 62, as is a tank outlet passage 70. When positioned as shown in the drawing, the valve 62 provides communication between passages 64 and 68 and between passages 66 and 70, i.e. the pressure conduit 22 is connected to pressure outlet passage 68 and the tank conduit 24 is connected to the tank outlet passage 70. The shuttle valve 62 includes internal passages which assure this valve will be in the position shown whenever the inner tube 36 is connected to high pressure because this high pressure acts on the right end of the spool of valve 62, causing it to be shifted to the left. When the control valve 42 is shifted so that high pressure is directed to the outer tube 38, the pressure acting on the left end of the spool of valve 62 will cause the valve 62 to shift to right. When shifted to the right, passage 66, transmitting the high pressure, will be connected to the passage 68, while a return path is provided through passage 70 communicating with the passage 64. Thus, the pressure outlet passage 68 will be connected with the pressure conduit 22 and the tank outlet passage 70 will be connected with the tank conduit 24 regardless of the position of the valve 42.

A telescope cylinder control valve 72 is carried by the extend tube 14 and is connected to the passages 68 and 70. A passage 74 is connected between the valve 72 and the rod end of a telescope cylinder 76 also carried by the extend tube 14. A passage 78 connects with the valve 72 and branches to connect with the head end of telescope cylinder 76 and with an extend latch cylinder 90. A latch piston 82 having a protruding latch pin 84, capable of engaging a complementary hole 86 in the arm 18, is reciprocably retained within the cylinder 80. The piston 82 is biased to extend the pin 84 and lock the arm 18 relative to the extend tube and is retracted by pressure in passage 78. The spool of control valve 72 has a protruding rod 88 and is spring biased toward the left. In the position shown, the control valve 72 connects the pressure outlet passage 68 with the passage 74 and the tank outlet passage 70 with the passage 78. When the extend piston 32 and rod 34 are fully retracted, the control rod 88 will contact a shift block 90 mounted on the base 12 and cause the spool of valve 72 to be shifted to the right. When positioned to the right, the passage 78 will be connected to pressure passage 68 and passage 74 will be connected with the tank passage 70. A piston 92 reciprocably retained within telescope cylinder 70 and having a rod 94 attached thereto will have its head end pressurized through passage 78 and its rod and connected to tank through passage 74. The pressure in passage 78 will also simultaneously retract the pin 84 and the rod 94 will extend.

The rod 94 has a pair of internal passages which may take the form of two independent concentric inner and outer tubes 96 and 98 respectively. The inner tube communicates with the head end side of the piston 92 and the outer tube 98 communicates with the rod end side.

The tubes 96 and 98 attached to the arm 18, so that extension of the rod 94 will also extend the arm 18. A shuttle valve 100, which is similar to valve 62, is carried by the arm 18 and is connected to the inner tube 96 through passage 102 and to the outer tube 98 through passage 104. Pressure and tank passages 106 and 108 respectively also connect with the valve 100. The spool of valve 100 has internal passages so that pressure in the head end of cylinder 70 will be communicated to the left end of the spool through the inner tube 96 and passage 102 shifting the spool to the right. The pressure passage 106 then will be connected with the passage 102 and the tank passage 108 with the passage 104. Similar to the passages 68 and 70, the pressure passage 106 will always be connected with high pressure in conduit 22 and the pressure passage 108 will always be connected with the tank conduit 108, because when the pressure in the inner and outer tubes are reversed to retract the telescope piston and rod, the higher pressure on the right end of the spool of valve 100 will shift it to the left connecting the pressure passage 106 with the high pressure and the tank passage 108 with tank pressure. Thus, a remote hydraulic device attached to the free end of the arm 18 will have a constant pressure source through passage 106 and a return to tank through passage 108.

It should be noted that the pressure and return lines are provided for any remote hydraulic device without the need to route hydraulic hoses between the base 12 and the end of arm 18. All of the routing is internal of the rods 34 and 94 and as a consequence the problems normally encountered with flexible hoses to effect such a connection are avoided.

While one embodiment of the present invention has been illustrated and described herein, it is to be understood that various changes and modifications may be made therein without departing from the spirit of the invention as defined by the scope of the appended claims.

What is claimed is:

1. A hydraulic fluid transfer arrangement comprising:

a base;

an extend tube reciprocably mounted on said base;

an extend cylinder mounted on said base and having an extend piston reciprocably retained therein adapted to extend or retract said extend tube upon the application of a high pressure to one side of said extend cylinder and a lower pressure to the other side of said extend cylinder;

a pair of concentric tubes attached to said extend piston and to said extend tube, the inner tube communicating with a first side of said extend cylinder and the outer tube with a second side;

pressure and tank passages in said extend tube;

a first shuttle valve on said extend tube with separate passages connecting said valve with said inner and outer tubes, said shuttle valve communicating said pressure and tank passages with opposite sides of said extend cylinder; and said shuttle valve having internal ports and reaction surfaces to shift said valve so that said pressure passage is always subjected to high pressure and said tank passage is always subjected to low pressure despite shifting of the application of said high pressure from one side of said extend cylinder to the other.

2. The invention according to claim 1 and further comprising;

a telescope cylinder carried by said extend tube;

a telescope piston reciprocably retained within telescope cylinder and having a rod attached thereto which extends through one end of said telescope cylinder;

a control valve carried by said extend tube and normally positioned to connect said pressure passage with the rod end of said telescope cylinder and said tank passage with the other end of said telescope cylinder; and means for shifting said control valve when said extend piston is fully retracted to reverse the connection of said passages with said telescope cylinder, whereby said telescope piston extends only after said extend piston is fully retracted.

3. The invention according to claim 2 and further comprising;

an arm reciprocable within said extend tube and attached to said rod;

a telescope latch carried by said extend tube and engagable with said arm; and release passage means connecting said latch with high pressure when said control valve is shifted to release said latch.

4. The invention according to claim 3, wherein said rod comprises;

first and second longitudinal passages; and said first passage is connected to the other end side of said telescope cylinder and said second passage is connected to the rod end side of said telescope cylinder.

5. The invention according to claim 4, and further comprising;

a second shuttle valve carried by said arm and connected to said first and second passages;

remote device pressure and return passages connected to second shuttle valve; and internal passages in said second shuttle valve to assure that said remote passage always are properly connected to high and low pressures, respectively, as recited in claim 1.

* * * * *